US011879186B2

(12) United States Patent
Diedrich

(10) Patent No.: US 11,879,186 B2
(45) Date of Patent: Jan. 23, 2024

(54) DRAFTING SYSTEM AND DRAFTING SYSTEM UNIT FOR A SPINNING MACHINE

(71) Applicant: Saurer Spinning Solutions GmbH & Co. KG, Uebach-Palenberg (DE)

(72) Inventor: Joachim Diedrich, Stuttgart (DE)

(73) Assignee: Saurer Spinning Solutions GmbH & Co. KG, Übach-Palenberg (DE)

( * ) Notice: Subject to any disclaimer, the term of this patent is extended or adjusted under 35 U.S.C. 154(b) by 455 days.

(21) Appl. No.: 16/419,302

(22) Filed: May 22, 2019

(65) Prior Publication Data

US 2019/0360128 A1 Nov. 28, 2019

(30) Foreign Application Priority Data

May 24, 2018 (DE) ..... 10 2018 112 422.8

(51) Int. Cl.

| | |
|---|---|
| ***D01H 5/48*** | (2006.01) |
| *D01H 5/56* | (2006.01) |
| *D01H 5/46* | (2006.01) |
| *D01H 3/00* | (2006.01) |

(52) U.S. Cl.

CPC ..... *D01H 5/48* (2013.01); *D01H 3/00* (2013.01); *D01H 5/46* (2013.01); *D01H 5/565* (2013.01)

(58) Field of Classification Search

CPC ..... D01H 5/48; D01H 3/00; D01H 5/565; D01H 5/46

USPC ..... 57/315

See application file for complete search history.

(56) References Cited

U.S. PATENT DOCUMENTS 715,502 A * 12/1902 Norman ..... D01H 5/48 19/276
905,668 A * 12/1908 Dixon ..... D01H 5/48 19/276
1,218,659 A * 3/1917 Houghton ..... D01H 5/48 19/276

(Continued)

FOREIGN PATENT DOCUMENTS

CN 101092770 A 12/2007
CN 101194056 A 6/2008

(Continued)

OTHER PUBLICATIONS

DE3209210A1 Translation (Year: 2022).*

(Continued)

*Primary Examiner* — Alissa J Tompkins
*Assistant Examiner* — Dakota Marin
(74) *Attorney, Agent, or Firm* — Nelson Mullins Riley & Scarborough LLP

(57) ABSTRACT

A drafting system for a spinning machine, which drafting system has a drafting system unit, and to such a drafting system unit, having at least one weighting arm, which can be pivoted between an operating position and an open position by a repositioning device. In order to provide a drafting system and a drafting system unit for a drafting system for a spinning machine, the drafting system unit having a particularly simple design and permitting user-friendly operation, it is provided that the at least one weighting arm is connected to a retaining rod for conjoint rotation, which retaining rod is mounted on a retaining rod holder for rotation about the longitudinal axis of the retaining rod by the repositioning device.

9 Claims, 3 Drawing Sheets

(56) References Cited

U.S. PATENT DOCUMENTS 1,265,306 A * 5/1918 Dixon ..... D01H 5/48 19/284
1,428,271 A * 9/1922 Butler ..... D01H 13/04 19/291
1,448,192 A * 3/1923 Butler ..... D01H 5/18 19/287
1,449,929 A * 3/1923 Albrecht ..... D01H 5/48 19/269
1,485,871 A * 3/1924 Naumburg ..... D01H 5/48 19/283
1,623,688 A * 4/1927 Lawton ..... D01H 5/48 19/284
1,673,448 A * 6/1928 Fyans ..... D01H 5/48 19/276
1,932,799 A * 10/1933 Morton ..... D01H 5/48 19/271
1,959,872 A * 5/1934 McBee ..... D01H 5/48 19/275
1,991,873 A * 2/1935 Stubbs ..... D01H 5/48 19/276
2,032,298 A * 2/1936 Morton ..... D01H 5/48 19/271
2,075,484 A * 3/1937 Truslow ..... D01H 5/48 19/284
2,263,975 A * 11/1941 West ..... D01H 5/48 19/269
2,565,228 A * 8/1951 Gwaltney ..... D01H 5/505 19/280
2,675,586 A * 4/1954 Hohloch ..... D01H 5/50 19/267
2,689,383 A * 9/1954 Adams ..... D01H 5/26 19/251
2,787,025 A * 4/1957 Solanas ..... D01H 5/565 19/280
2,807,053 A * 9/1957 King, Jr. ..... D01H 5/48 19/275
2,834,996 A * 5/1958 Rulon-Miller ..... D01H 5/56 19/276
2,943,364 A * 7/1960 Solanas ..... D01H 5/26 19/281
2,947,039 A * 8/1960 Rulon-Miller ..... D01H 5/22 19/294
3,044,128 A * 7/1962 Gerber ..... D01H 5/565 19/295
3,350,021 A * 10/1967 Marciniak ..... B65H 54/325 242/484.6
3,568,258 A * 3/1971 Schiltknecht et al. ..... D01H 5/525 19/295
3,606,646 A * 9/1971 Tarbox et al. ..... D01H 5/50 19/267
3,609,820 A * 10/1971 Hohloch ..... D01H 5/565 19/267
3,663,992 A * 5/1972 Ooki ..... D01H 5/505 19/295
3,732,596 A * 5/1973 Staneff ..... D01H 5/565 19/267
3,748,694 A * 7/1973 Staneff ..... D01H 5/26 19/293
4,480,354 A * 11/1984 Glock ..... D01H 13/188 19/0.25
4,484,376 A * 11/1984 Glock ..... D01H 13/188 19/244
4,635,321 A * 1/1987 Dupper ..... D01H 13/14 19/236
4,644,609 A * 2/1987 Lattner ..... D01H 13/185 19/244
4,727,713 A * 3/1988 Konig ..... D01H 13/185 19/0.25
4,878,268 A * 11/1989 Mirabel ..... D01H 5/18 19/258
4,951,357 A * 8/1990 Grau ..... D01H 13/185 19/0.25
4,953,349 A * 9/1990 Fehrer ..... D01H 5/26 57/352
4,969,238 A * 11/1990 Schulz ..... D01H 5/44 19/260
5,035,027 A * 7/1991 Grau ..... D01H 5/46 19/258
5,172,542 A * 12/1992 Stahlecker ..... D01H 1/115 57/300
5,343,689 A * 9/1994 Sasaki ..... D01H 15/00 57/261
5,915,510 A * 6/1999 Dinkelmann ..... D01H 5/72 19/246
5,918,456 A * 7/1999 Darcis ..... D01H 5/88 19/252
6,332,246 B1 * 12/2001 Camozzi ..... D01H 1/22 19/244
2007/0111000 A1 * 5/2007 Ke ..... D02G 3/443 428/373
2015/0020495 A1 * 1/2015 Ke ..... D01H 4/30 57/315
2015/0252497 A1 * 9/2015 Xie ..... D01H 13/14 57/328

FOREIGN PATENT DOCUMENTS

DE 2019352 A1 11/1971
DE 2019352 C3 12/1974
DE 3209210 A1 * 11/1985
DE 3209210 C2 11/1985
DE 3904108 A1 8/1990
DE 102006020419 A1 10/2007
DE 102016006066 A1 11/2017
EP 0887448 A2 12/1998
EP 1469107 A2 10/2004
JP S38-1515 B 2/1963
JP S47-7217 B 3/1972
JP S5039518 U 4/1975
JP S55-51391 U 4/1980
UZ 522 C1 1/1978
WO 2005113872 A1 12/2005

OTHER PUBLICATIONS

Extended European Search Report, European Application No. 19175866.3, dated Sep. 4, 2019.
Office Action from Indian Patent Application No. 201924019945, dated Oct. 29, 2021.
Office Action from Bangladeshi Patent Application No. 61/2019/63, dated Jan. 6, 2020.
Office Action from corresponding Chinese Patent Application No. 201910421545.2, dated May 28, 2021, (no English translation readily available).
Examination Report from Pakistan Patent Application No. 338/2019, dated Aug. 12, 2020.
Office Action from corresponding Japanese Patent Application No. 2019-096673, dated Jan. 24, 2023, (no English translation readily available).

* cited by examiner

DRAFTING SYSTEM AND DRAFTING SYSTEM UNIT FOR A SPINNING MACHINE

CROSS-REFERENCE TO RELATED APPLICATIONS

This application claims priority from German National Patent Application No. 10 2018 112 422.8, filed May 24, 2018, entitled "Streckwerk sowie Streckwerkeinheit für eine Spinnmaschine", the entire contents of which are incorporated herein by reference.

FIELD OF THE INVENTION

The invention relates to a drafting system for a spinning machine, which drafting system has a drafting system unit, and to such a drafting system unit, comprising at least one weighting arm, which can be pivoted between an operating position and an open position by a repositioning device.

BACKGROUND OF THE INVENTION

Drafting systems of various embodiments for spinning machines are known from the prior art. They are used to draft or draw a sliver, whereby the cross-section of the fiber is reduced. During the drawing, the fibers must be slid relative to each other as evenly as possible so that an even sliver is achieved, which is a prerequisite for producing an even yarn. In order to draft the sliver, the drafting systems generally have a plurality of roller pairs arranged one after the other, which pairs of rollers, arranged lying on each other, clamp the sliver running therebetween. A roller pair usually consists of a driven lower roller and an upper pressure roller lying on the lower roller. Drafting of the sliver is achieved in that the circumferential speed increases from roller pair to roller pair in the transporting direction of the sliver defined by the direction of rotation of the roller pairs.

A drafting system unit having a weighting arm of the type described above is an assembly of a drafting system of a spinning machine which, because of its design, provides the possibility of lifting the weighting arm, with the pressure rollers usually arranged on the weighting arm, from the lower rollers, for example in order to convert or adjust the drafting system.

However, known possibilities for repositioning weighting arms have the disadvantage that, particularly for the simultaneous repositioning of a plurality of weighting arms coupled to each other, which for example guide and weight a common upper roller, high actuation forces are required. Such weighting arms also require a tightly toleranced or precisely oriented position relative to each other.

SUMMARY OF THE INVENTION

The problem addressed by the invention is that of providing a drafting system and a drafting system unit for a drafting system for a spinning machine, the drafting system unit having a particularly simple design and permitting user-friendly operation in that in particular a more simplified actuation of a plurality of weighting arms to be simultaneously opened or closed is ensured by reducing the actuation force applied.

The invention solves the problem by a drafting system unit for a spinning machine, comprising at least one weighting arm, which can be pivoted between an operating position and an open position by a repositioning device, characterized in that: the at least one weighting arm is connected to a retaining rod for conjoint rotation, which retaining rod is mounted on a retaining rod holder for rotation about the longitudinal axis of the retaining rod by the repositioning device.

The invention solves the problem by a drafting system for a spinning machine, comprising a drafting system unit, which has at least, one weighting arm, which can be pivoted between an operating position and an open position by a repositioning device, characterized in that; the at least one weighting arm is connected to a retaining rod for conjoint rotation, which retaining rod is mounted on a retaining rod holder for rotation about the longitudinal axis of the retaining, rod by the repositioning device.

Advantageous further developments of the drafting system unit include but are not limited to the following.

The repositioning device has a knee lever assembly, which is operatively connected to the retaining rod and which can be repositioned between a closing position associated with the operating position and an opening position associated with the open position.

The closing position the knee lever assembly is arranged in a position beyond dead center.

The knee lever assembly has a first knee lever and a second knee ever, the first knee lever being pivotable about a first joint axis, which is stationary relative to the retaining rod, the first knee lever and the second knee lever being articulated to each other by a knee lever joint axis, and the second knee lever having a knee lever portion spaced apart from the knee lever joint axis, which knee lever portion is connected to the retaining rod so as to transmit a rotational motion.

The closing position the knee lever assembly is arranged in a position beyond dead center.

The second knee lever is articulated, at an end opposite the knee lever joint axis and constituting a knee lever portion, to a link by a second joint axis, which link is connected, at the end thereof opposite the second joint axis, to the retaining rod for conjoint rotation.

The knee lever assembly can be repositioned between the operating position and the closing position by a hand lever.

The hand lever can be pivoted, together with the first knee lever, about the first joint axis.

The at least one weighting arm is connected to a retaining rod for conjoint rotation, which retaining rod ran be rotated about the longitudinal axis thereof by the repositioning device and is mounted on a retaining rod holder. The connection of one or more weighting arms to a central retaining rod for conjoint rotation makes a possible to bring about a reliable repositioning of one or more weighting arms arranged on the retaining rod by simply rotating the retaining rod about the longitudinal axis thereof. The repositioning device is used to reposition the retaining rod, which repositioning device enables, at a predefined position easily accessible to a user/operator, comfortable movement of the at least one weighting UM between the operating position and the open position.

The drafting system unit is distinguished in that the drafting system unit enables reliable positioning of the one or more weighting arms in the desired position. Furthermore, further connecting elements between the weighting arms are rendered unnecessary. In comparison with the repositioning of individual weighting arms alone, the retaining rod repositionable by the repositioning device also has the advantage that the securing of the position of all weighting, arms arranged on the retaining rod can be ensured by locking the retaining rod in the desired position.

In principle, the repositioning device for moving the retaining rod can be of any embodiment. According to a preferred further embodiment of the invention, the repositioning device has a knee lever assembly, which is operatively connected to the retaining rod and which can be repositioned between a closing position associated with the operating position and an opening position associated with the open position. The embodiment of the repositioning device with a knee lever assembly enables particularly comfortable and force-saving repositioning of the one or more weighting arms between the operating position and the open position. The embodiment of the knee lever assembly can be such that the desired actuation forces are taken into consideration and therefore enables comfortable rotating of the retaining rod and of all the weighting arms arranged on the retaining rod.

As stated above, in principle the embodiment of the knee lever assembly can be freely chosen. According to another preferred embodiment of the invention, the knee lever assembly has a first knee lever and a second knee lever, the first knee lever being pivotable about a first joint axis, which is stationary relative to the retaining rod, the first knee lever and the second knee lever being articulated to each other by a knee lever joint axis, and the second knee lever having a knee lever portion spaced apart from the knee lever joint axis, which knee lever portion is connected to the retaining rod so as to transmit a rotational motion.

According to this embodiment of the invention, the first, knee lever is fastened relative to the retaining rod by the first joint axis of the first knee lever. This can be realized, for example, in that the retaining rod and the first knee lever are rotatably mounted on a common component, for example on a common portion of a machine frame of the drafting system unit, in order to transfer a repositioning of the knee lever assembly to the retaining rod, the knee lever portion of the second knee lever spaced apart from the knee lever joint axis, which knee lever portion can be, in particular, a knee lever end opposite the knee lever joint axis, is connected to the retaining rod for the transmission of a rotational motion, so that a repositioning of the first and second knee levers, which in particular are articulated to each other by a common knee lever joint axis, causes a rotation of the retaining rod. Such an embodiment of the drafting system unit is distinguished by the particularly simple design thereof, which enables reliable force transmission and, at the same time, definition of the actuation forces.

In principle, the operating position of the at least one weighting arm can be secured in any way, for example by suitable locking elements that lock the knee lever assembly in the closing position. According to a preferred further embodiment of the invention, in the closing position the knee lever assembly is arranged in a position beyond dead center. A corresponding embodiment of the knee lever assembly is distinguished in that separate locking elements for the closing position are rendered unnecessary and that it is ensured in a particularly simple and reliable manner that the at least one weighting arm does not independently move toward the open position during operation as a result of the forces then occurring.

According to another preferred embodiment of the invention, the second knee lever is articulated, at an end opposite the knee lever joint axis, to a link by a second joint axis, which link is connected, at the end thereof opposite the second joint axis, to the retaining rod for conjoint rotation, According to this preferred embodiment of the invention, the second knee lever of the knee lever assembly is articulated to a link, a link portion of which spaced apart from the second knee lever is coupled to or arranged on the retaining rod for conjoint rotation. Thus, actuation forces can be reduced further and the operating characteristic of the repositioning of the at least, one weighting arm between the operating position and the open position can be defined within a wide range.

Actuation of the repositioning device, by which the retaining rod is rotated about the longitudinal axis thereof or an advantageously provided knee lever assembly is repositioned between the closing position and the opening position, can in principle occur in any manner. For example, the use of different electrically, hydraulically or pneumatically operating drives is conceivable here. However, according to a preferred further embodiment of the invention, it is provided that the knee lever assembly can be repositioned between the operating position and the closing position by a hand lever. The use of a hand lever is distinguished by exceptional simplicity and low susceptibility to failure, and because the knee lever assembly is used the actuation forces lie within a range that is comfortable for a user.

The connection between the hand lever and the knee lever assembly can be freely selected in view of the constructional circumstances. According to another preferred embodiment of the invention, the hand lever can be pivoted, together with the first knee lever, about the first joint axis. Mounting of the hand lever for pivoting about the first joint axis of the first knee lever enables a particularly compact and simple design, since a further bearing axis for the hand lever is rendered unnecessary. More preferably, the hand lever is rigidly connected to, more particularly configured as a single piece with, the first knee lever. The rigid connection of the hand lever to the first knee lever additionally enables a simpler design and a more force-saving and more comfortable repositioning of the knee lever assembly between the closing position and the opening position. Alternatively thereto, it is conceivable that the hand lever can be designed for engagement with the knee lever assembly by engagement elements so that actuation of the hand lever leads, by the engagement elements, which couple the hand lever to the knee lever assembly for force transmission, to actuation or to movement of the knee lever assembly that rotates the retaining rod. In comparison with a rigid connection, this alternative embodiment enables an additional degree of freedom for the constructional layout and arrangement of the components constituting the repositioning device. The engagement elements can be configured, for example, by a hole and a protrusion, pin, projection or the like interacting with the hole, either the hand lever or the knee lever assembly having the hole and the other having the component interacting with the hole. In this regard, releasable locking connections are also conceivable as engagement elements.

The drafting system according to the invention is characterized in that said drafting system has a drafting system unit in which one or more weighting arms are connected to a common retaining rod for conjoint rotation, which retaining rod can be rotated about the longitudinal axis thereof between an operating position and an open, position of the weighting arms by a repositioning device. The retaining rod is rotatably mounted on a retaining rod holder and, because of the rotatability of the retaining rod, enables reliable moving and positioning of all weighting arms arranged on the retaining rod. Position securing of the weighting arms can also be achieved centrally by the repositioning, device so that individual locking means for each weighting arm are rendered unnecessary. Further embodiments of the drafting system result from the possible further developments of the drafting system unit presented above.

BRIEF DESCRIPTION OF THE DRAWINGS

An embodiment example of the invention is explained below with reference to the drawing. The following is shown in the drawings.

DESCRIPTION OF THE PREFERRED EMBODIMENTS

Figure 1:
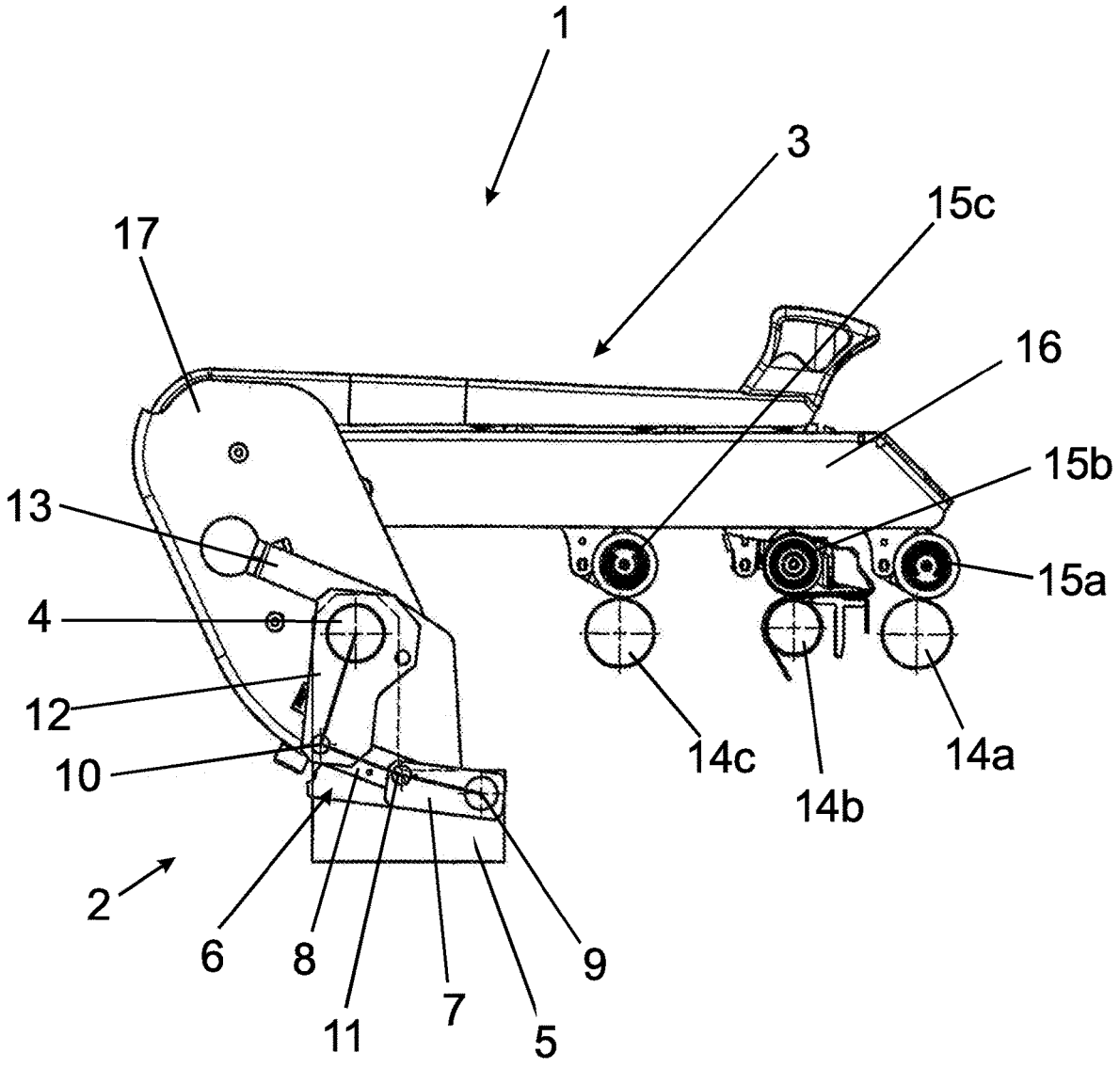
FIG. 1 is a side view of a drafting system unit of a spinning machine in an operating position of a weighting arm.

A drafting system unit 1 presented in FIG. 1, of a spinning machine not shown in greater detail here, serves to draft a sliver between the pressure rollers 15*a*, 15*b*, 15*c*, which are arranged on a support arm 16 of a weighting arm 3, and the further lower rollers 14*a*, 14*b*, 14*c* of the drafting system, which is not shown here. For this purpose, the roller pairs, which are each formed by one of the lower rollers 14*a*, 14*b*, 14*c* and one of the pressure rollers 15*a*, 15*b*, 15*c*, have a different rotational speed, which increases in the transporting direction, so that the sliver is drafted in the region between the roller pairs.

Figure 3:
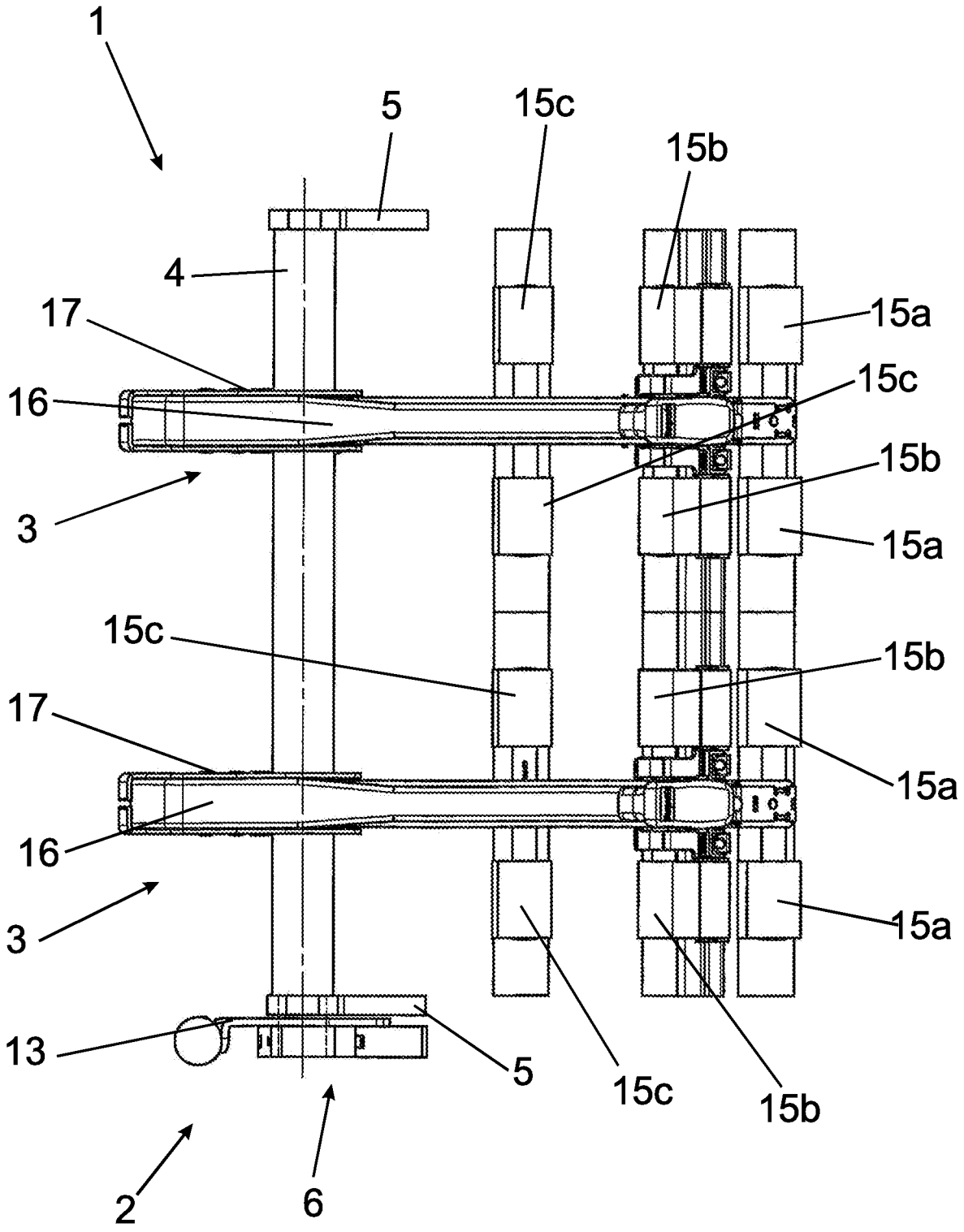
FIG. 3 is a top view of the drafting system unit of FIG. 1 in the operating position.

In the presented embodiment example, the drafting system unit 1 has two weighting arms 3, which are arranged parallel to each other on a retaining rod 4 and which each have a support arm 16, each having three pressure roller pairs formed by two pressure rollers 15*a*, 15*b*, 15*c*, the axes of rotation of which extend perpendicularly to the longitudinal axis of the associated support arm 16. The support arms 16 are each rigidly connected to two support bodies 17, which are arranged on both sides of the support arm 16 and which in turn are connected to a retaining rod 4 for conjoint rotation (see FIG. 3).

In the operating position of the support arms 16, which is presented in FIG. 1, the pressure rollers 15*a*, 15*b*, 15*c* are in contact with the lower rollers 14*a*, 14*b*, 14*c* in order to thus draft the sliver arranged therebetween. In order to load or equip the spinning machine, the sliver must be arranged between the lower rollers 14*a*, 14*b*, 14*c* and the pressure rollers 15*a*, 15*b*, 15*c*, For this purpose, the weighting arms 3 can be pivoted out of the operating position, which is presented in FIG. 1, into an open position, which is presented in FIG. 2, in which open position the pressure rollers 15*a*, 15*b*, 15*c* are lifted from the lower rollers 14*a*, 14*b*, 14*c*.

In order to reposition the weighting arms 3 from the operating position into the open position, a repositioning device 2 is provided, which pivots the support arm 16, together with the support bodies 17 connected to the support arm 16, about a longitudinal axis of the retaining rod 4. Pivoting results from rotation of the retaining rod 4, which is rotatably mounted on a retaining rod holder 5, e.g. a machine housing. Because of the arrangement of the support bodies 17 on the retaining rod 4 for conjoint rotation, rotation of the retaining rod 4 in the retaining rod holder 5 causes movement of the weighting arm 3 in accordance with the rotational motion of the retaining rod 4 caused by the repositioning device.

In order to reposition the retaining rod 4, the repositioning device 2 has a knee lever assembly 6, which can be repositioned between a closing position associated with the operating position and an opening position associated with the open position by a hand lever 13.

The knee lever assembly 6 has a first knee lever 7, which according to a preferred embodiment example can be pivoted at the retaining rod holder 5 about a first joint axis 9. According to another preferred embodiment example, which is not presented, the retaining rod holder and the first joint axis are spaced apart from each other. At the end opposite the first joint axis 9, the first knee lever 7 is connected to the second knee lever 8 by a knee lever joint axis 11. The second knee lever 8 is connected, at a knee lever portion spaced apart from the knee lever joint axis 11, in this preferred embodiment example at the end of the second knee lever 8 opposite the knee lever joint axis 11, to a link 12 by a second joint axis 10, which link 12 is connected, at the end opposite the second joint axis 10, to the retaining rod 4 for conjoint rotation so that the rotation of the link 12 causes a repositioning of the retaining rod 4 and thus a movement of the weighting arm 3. In order to reposition the knee lever assembly 6, a hand lever 13 is used, which can be pivoted about the first joint axis 9 and interacts with the knee lever assembly 6. According to a preferred embodiment example, the hand lever 13 is rigidly connected to the first knee lever 7, and thus movement of the hand lever 13 leads directly to actuation of the first knee lever 7. In a preferred manner, the hand lever 13 and the first knee lever 7 are configured from one material piece. In an alternatively preferred manner, the hand lever 13 and the first knee lever can be configured from two material pieces, which are connected to each other, for example by typical measures of interlocking connection, bonded connection or frictional connection.

Figure 2:
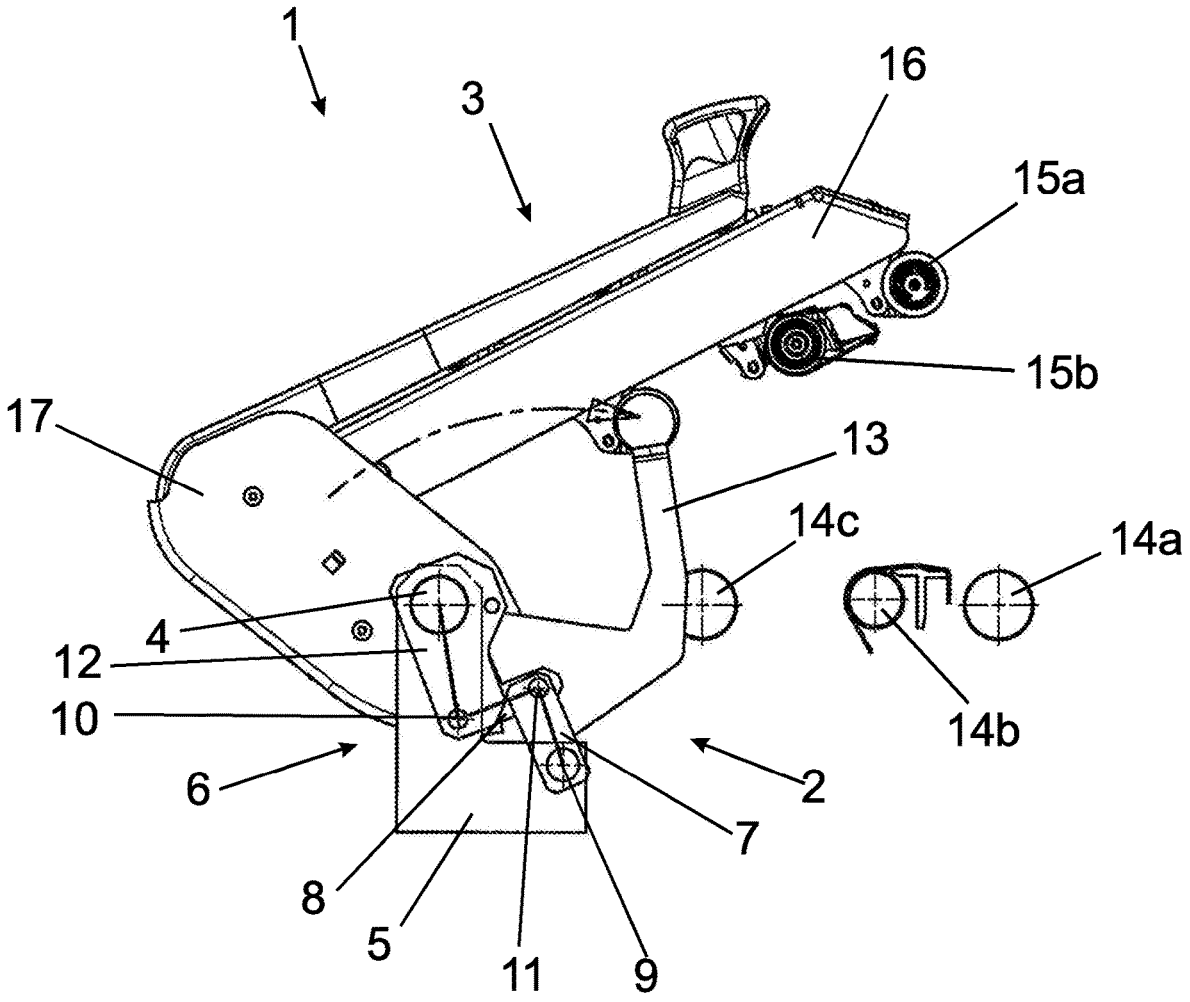
FIG. 2 is a side view of the drafting system unit of FIG. 1 in an open position of the weighting arm.

In order to reposition the knee lever assembly 6 from the closing position, which is presented in FIG. 1, into the opening position, which is presented in FIG. 2, the hand lever 13 transfers the knee lever assembly 6 from a position beyond dead center into the opening position. In order to move the weighting arm 3 into the operating position, merely an opposite reverse movement of the hand lever 13 from the open position, which is presented in FIG. 2, into the operating position, which is presented in FIG. 1, is required, the hand lever 13 transferring the knee lever assembly 6 into the position beyond dead center.

LIST OF REFERENCE NUMBERS

1 Drafting system unit
2 Repositioning device
3 Weighting an
4 Retaining rod
5 Retaining, rod holder
6 Knee lever assembly
7 First knee lever
8 Second knee lever
9 First joint, axis
10 Second joint axis
11 Knee lever joint axis
12 Link
13 Hand lever
14*a*, 14*b*, 14*c* Lower rollers
15*a*, 15*b*, 15*c* Pressure rollers
16 Support arm
17 Support body It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A drafting system unit for a spinning machine, comprising at least two weighting arms, which are pivotable between an operating position and an open position by a repositioning device, characterized in that:

the at least two weighting arms are each connected to a single common retaining rod for conjoint rotation of the at least two weighting arms together with the single common retaining rod, which single common retaining rod is mounted on a retaining rod holder for common rotation together with the at least two weighting arms about the longitudinal axis of the retaining rod by the repositioning device, characterized in that the repositioning device has a knee lever assembly, which is operatively connected to the retaining rod and which is repositionable between a closing position associated with the operating position and an opening position associated with the open position, characterized in that the knee lever assembly has a first knee lever and a second knee lever, the first knee lever being pivotable about a first joint axis, which is stationary relative to the retaining rod, the first knee lever and the second knee lever being articulated to each other by a knee lever joint axis, and the second knee lever having a knee lever portion spaced apart from the knee lever joint axis, which knee lever portion is connected to the retaining rod so as to transmit a rotational motion.

2. The drafting system unit according to claim 1, characterized in that the second knee lever is articulated, at an end opposite the knee lever joint axis and constituting a knee lever portion, to a link by a second joint axis, which link is connected, at the end thereof opposite the second joint axis, to the retaining rod for conjoint rotation.

3. The drafting system unit according to claim 2, characterized in that the knee lever assembly is repositionable between the operating position and the closing position by a hand lever.

4. The drafting system unit according to claim 3, characterized in that the hand lever is pivotable, together with the first knee lever, about the first joint axis.

5. A drafting system for a spinning machine, comprising a drafting system unit, which has at least one weighting arm, which is pivotable between an operating position and an open position by a repositioning device, characterized in that:

the at least one weighting arm is connected to a retaining rod for conjoint rotation, which retaining rod is mounted on a retaining rod holder for rotation about the longitudinal axis of the retaining rod by the repositioning device, characterized in that the repositioning device has a knee lever assembly, which is operatively connected to the retaining rod and which is repositionable between a closing position associated with the operating position and an opening position associated with the open position, characterized in that the knee lever assembly has a first knee lever and a second knee lever, the first knee lever being pivotable about a first joint axis, which is stationary relative to the retaining rod, the first knee lever and the second knee lever being articulated to each other by a knee lever joint axis, and the second knee lever having a knee lever portion spaced apart from the knee lever joint axis, which knee lever portion is connected to the retaining rod so as to transmit a rotational motion.

6. The drafting system according to claim 5, characterized in that in the closing position the knee lever assembly is arranged in a position beyond dead center of the at least one weighting arm.

7. The drafting system unit according to claim 5, characterized in that the second knee lever is articulated, at an end opposite the knee lever joint axis and constituting a knee lever portion, to a link by a second joint axis, which link is connected, at the end thereof opposite the second joint axis, to the retaining rod for conjoint rotation.

8. The drafting system unit according to claim 7, characterized in that the knee lever assembly is repositionable between the operating position and the closing position by a hand lever.

9. The drafting system unit according to claim 8, characterized in that the hand lever is pivotable, together with the first knee lever, about the first joint axis.

* * * * *